US010272321B2

(12) United States Patent
Hilt

(10) Patent No.: US 10,272,321 B2
(45) Date of Patent: Apr. 30, 2019

(54) LOCOMOTION DEVICE ON CASTORS

(71) Applicant: COMMISSARIAT A L'ENERGIE ATOMIQUE ET AUX ENERGIES ALTERNATIVES, Paris (FR)

(72) Inventor: Thierry Hilt, Barraux (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 15/564,900

(22) PCT Filed: Apr. 4, 2016

(86) PCT No.: PCT/FR2016/050758
§ 371 (c)(1),
(2) Date: Oct. 6, 2017

(87) PCT Pub. No.: WO2016/162619
PCT Pub. Date: Oct. 13, 2016

(65) Prior Publication Data

US 2018/0093164 A1 Apr. 5, 2018

(30) Foreign Application Priority Data

Apr. 9, 2015 (FR) ..... 15 53079

(51) Int. Cl.
*A63C 17/06* (2006.01)
*A63C 17/14* (2006.01)

(52) U.S. Cl.
CPC ..... *A63C 17/064* (2013.01); *A63C 17/1427* (2013.01); *A63C 2203/18* (2013.01)

(58) Field of Classification Search
CPC ..... A63C 17/064; A63C 17/1427; A63C 17/0033; A63C 17/14; A63C 2203/18; A63C 2203/52
See application file for complete search history.

(56) References Cited

U.S. PATENT DOCUMENTS 3,771,811 A * 11/1973 Bueno ..... A63C 17/01 280/87.042
3,827,706 A 8/1974 Milliman
(Continued)

FOREIGN PATENT DOCUMENTS

DE 29 067 25 A1 9/1980
FR 2 544 621 A1 10/1984
(Continued)

OTHER PUBLICATIONS

International Search Report dated Jun. 9, 2016, in PCT/FR2016/050758, filed Apr. 4, 2016.

*Primary Examiner* — Frank B Vanaman
(74) *Attorney, Agent, or Firm* — Oblon, McClelland, Maier & Neustadt, L.L.P.

(57) ABSTRACT

A locomotion device on castors including: at least one castor mechanically connected to a sole to roll along a ground, the castor being mounted to rotate about an axis of rolling parallel to a plane of the sole and also about an axis of rotation perpendicular to the plane of the sole; a controllable electromechanical braking device configured to apply a braking torque to the castor that varies according to a braking command received; an inertial unit configured to measure a physical parameter indicative of a steering angle; and a central processing unit programmed to establish the braking command according to the physical parameter measured by the inertial unit and to transmit the established braking command to the braking device to apply to the castor a braking torque that varies according to the steering angle.

12 Claims, 3 Drawing Sheets

(56) References Cited

U.S. PATENT DOCUMENTS

| | | | | |
|---|---|---|---|---|
| 5,192,088 | A * | 3/1993 | Yu | A63C 17/064 280/11.19 |
| 5,246,238 | A | 9/1993 | Brown | |
| 6,105,977 | A * | 8/2000 | Bengtsson | A63C 17/0033 280/11.227 |
| 6,270,096 | B1 * | 8/2001 | Cook | A63C 17/01 280/11.221 |
| 6,676,138 | B1 * | 1/2004 | Rosso | A63C 17/045 188/5 |
| 2002/0153205 | A1 | 10/2002 | Zinanti | |
| 2005/0146100 | A1 * | 7/2005 | Hurwitz | A63C 17/0066 280/11.223 |
| 2005/0151332 | A1 * | 7/2005 | Chen | A63C 17/0073 280/11.221 |
| 2013/0277924 | A1 | 10/2013 | Ng et al. | |
| 2014/0278218 | A1 * | 9/2014 | Chang | G01P 15/00 702/150 |
| 2017/0007910 | A1 * | 1/2017 | Ruschkowski | A63C 17/12 |

FOREIGN PATENT DOCUMENTS

| | | | |
|---|---|---|---|
| FR | 2 925 874 | A1 | 7/2009 |
| WO | 2006/117442 | A1 | 11/2006 |

* cited by examiner

LOCOMOTION DEVICE ON CASTORS

FIELD

The invention concerns a locomotion device on castors for moving over the ground.

Numerous locomotion devices on castors are known such as, for example, roller skates. However, braking with roller skates or any other similar locomotion device, such as skateboards or roller skis, requires great dexterity and necessitates numerous hours of practice before being perfectly mastered. In fact, to achieve this, it is often necessary to cause the castors to skid along the ground.

DESCRIPTION OF THE RELATED ART

Various improvements have already been imagined for remedying this drawback. For example, the application US2002153205, hereinafter denoted US205, describes a locomotion device and more particularly roller skates. Each roller skate includes:

- a footplate extending primarily in a plane termed the "footplate plane" and on which at least one of the feet of the user is intended to be placed when the device is being used by that user,
- at least one castor mechanically connected to the footplate to roll over the ground, this castor being mounted to rotate about a rolling axis parallel to the plane of the footplate and also about a rotation axis perpendicular to the plane of the footplate, and
- a braking device adapted to exert on the castor a braking torque the amplitude of which varies as a function of a turn angle, the turn angle being the angle between:
  - a longitudinal axis of the footplate, this longitudinal axis being fixed with no degree of freedom relative to the footplate and contained in the plane of the footplate, and
  - the orthogonal projection on the footplate plane of the instantaneous direction of movement of this footplate.

The device from US205 has a number of advantages notably including:

1. enabling braking without having to cause the castor to skid, and
2. imitating the behavior of ice skates or skis, i.e. triggering braking by pivoting the footplate relative to the instantaneous direction of movement of the device.

Advantage 2 is of particular interest because it greatly facilitates learning to brake the locomotion device.

To be more precise, in the device from US205, the castor is a ball and the braking torque is obtained by the rubbing of pads on this ball. The pads are placed on a rolling axis that passes through the center of the ball. Friction, and therefore braking torque, occur only if the ball rolls in a direction not collinear with this rolling axis, i.e. if the turn angle is non-zero. In the device from US205, braking is effected by friction between the pads and the ball. Now one feature of the latter is its great adhesion to the ground. It is typically made of a relatively soft polymer like the current known castors. Under these conditions, it is difficult to control friction over the small area of contact between the pad and the ball.

Prior art is also known from:

DE2906725A1,

FR2544621A1, and

U.S. Pat. No. 3,827,706A.

SUMMARY

The invention therefore aims to propose a locomotion device that has the same advantages as the device from US205 whilst enabling more precise control of the braking torque. It therefore consists in a locomotion device of the above kind conforming to claim 1.

The claimed device has the same advantages as that from US205. In fact, the fact that the castor can pivot about the rotation axis makes it possible to limit or even to prevent skidding of the castor on braking. Moreover, the fact that the braking torque exerted is a function of the amplitude of the turn angle also makes it possible to approximate the behavior of an ice skate, snowboard or ski.

Finally, in the claimed locomotion device, the amplitude of the braking torque depends primarily on the control of braking established by the central unit as a function of a measured physical parameter representing the turn angle. Thus it is much easier to regulate and to adjust the relationship between the amplitude of the braking torque and the turn angle.

Embodiments of this locomotion device can have one or more of the features of the dependent claims.

These embodiments of the locomotion device furthermore have the following advantages:

- The use of a controllable electromechanical device for turning the castor makes it possible for the castor to remain aligned with the instantaneous direction of movement of the footplate even if that castor is no longer touching the ground. This prevents jerks and uncontrolled braking that occur at the moment a castor again touches the ground after being raised. This therefore facilitates the use of the locomotion device.
- The use of an electric actuator common to the braking device and to the turning device simplifies the manufacture of the locomotion device.
- The use of a pawl, such as a grooved wheel, to tension and release the brake cable as a function of the pivoting of the wheel about its rotation axis enables simple implementation of a mechanism able to transform pivoting of this wheel into movement of the brake pad.
- The offsetting of the rolling axis of the castor relative to its rotation axis by a distance $\Delta$ enables the point of contact between the castor and the ground to be moved closer to the position that this contact point occupies on braking with an otherwise identical locomotion device in which the castor cannot pivot about a rotation axis.
- The use of a lead screw meshing with a gear to cause the castor to pivot about its rotation axis enables the pivot angle of the castor to be maintained without consuming (or minimizing the consumption of) electrical energy.
- Utilizing an actuator that controls the pressure exerted by the brake pads on the castors enables a braking torque to be obtained that does not depend on wear of the pads or the castors.
- Programming the central unit so that the amplitude of the braking torque increases as the turn angle increases enables realistic reproduction of the braking behavior of ice skates or skis. This therefore facilitates the use of the locomotion device.
- Programming the central unit so that the amplitude of the braking torque increases as the pivoting of the footplate relative to the instantaneous direction of movement increases also enables more accurate imitation of the braking behavior of ice skates or skis. This therefore facilitates control of the braking of the locomotion device by the user.

BRIEF DESCRIPTION OF THE DRAWINGS

The invention will be better understood on reading the following description given by way of nonlimiting example only and with reference to the drawings, in which.

In these figures, the same references are used to designate the same elements. In the remainder of this description, features and functions well known to a person skilled in the art are not described in detail.

DETAILED DESCRIPTION

Figure 1:
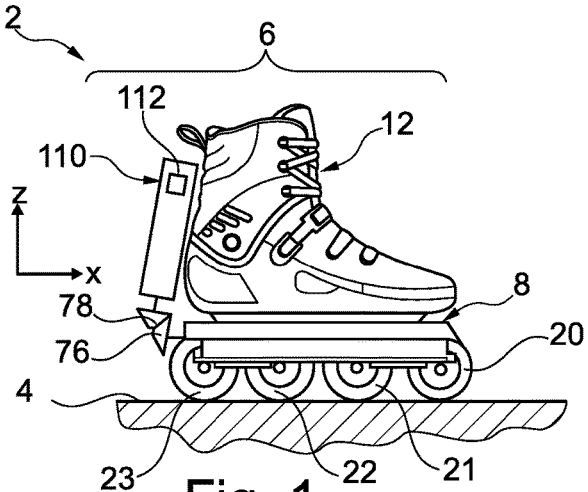
FIG. 1 is a diagrammatic side view of part of a locomotion device.

FIG. 1 shows part of a locomotion device 2. The device 2 enables a human being, referred to hereinafter as the user, to move by rolling over the ground 4. Here the surface of the ground 4 is plane and extends in a horizontal plane termed the ground plane. The device 2 is sufficiently light to be directly transported by hand by its user. For example, the device 2 weighs less than 25 kg or less than 15 kg and preferably less than 10 kg. Its overall size is also limited. For example. Its volume is less than 50 $cm^3$. In this embodiment, the device 2 has no propulsion means, i.e. no thermal or electric motor able to propel the device 2 and its user over the ground 4.

By way of illustration, the device 2 is described in the particular case where it consists of two roller skates. Each of the skates is intended to be worn on a respective foot of the user. To simplify FIG. 1 and the subsequent figures, only the right skate 6 is shown. The left skate of the device 2 is deduced from the right skate by symmetry.

Figure 2:
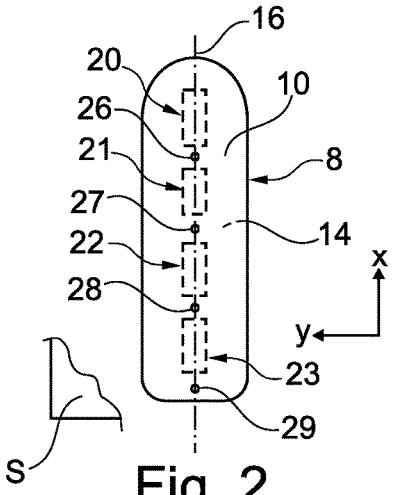
FIG. 2 is a diagrammatic plan view of a footplate of the device from FIG. 1.

The skate 6 includes a footplate 8 that extends primarily in a horizontal plane S (FIG. 2), termed the footplate plane. In FIGS. 1 and 2, this plane S is parallel to the ground 4.

Hereinafter, all the figures are oriented relative to an orthogonal system of axes XYZ fixed with no degree of freedom relative to this footplate 8. The directions X and Y are contained in the plane S.

The footplate 8 is described in more detail with reference to FIGS. 1 and 2. The footplate 8 is made from a rigid material that deforms very little under the weight of the user. For example, the maximum amplitude of its deformation in the direction Z between a situation in which the weight of the user rests on the footplate 8 and a situation in which the user is absent is strictly less than 10 cm and generally less than 1 cm or 5 mm for applications of roller skate type. The footplate 8 has an upper face 10 (FIG. 2) on which the right foot of the user rests when using the device 2.

The skate 6 includes an attachment device 12 for attaching the foot of the user to the base 10 of the footplate 8 so that the user can raise the skate 6 by raising their foot. In the particular case shown here, the attachment device 12 is a boot into which the user can insert their foot. However, any other attachment device may be suitable, such as, for example, straps or loops enabling the foot to be attached to the face 10 of the footplate 8.

The footplate 8 also has a lower face 14 (FIG. 2) opposite the face 10 and to which the castors are fixed.

The orthogonal projection of the footplate 8 in the plane S typically defines a shape that is longer than it is wide. The longitudinal axis 16 of the footplate 8 is defined as being the axis that passes through the center of this orthogonal projection of the footplate 8 in the plane S and is parallel to the longer side of the rectangle of smallest area that entirely contains this orthogonal projection. Here the center of an object is defined as being the barycenter of all the points of that object when each is assigned the same weight. Here the direction X of the system of axes XYZ is parallel to the axis 16. The transverse axis of the footplate 8 is then an axis contained in the plane S and parallel to the direction Y.

In this embodiment, the skate 6 includes four castors 20 to 23. Each castor is mounted to rotate about a respective rolling axis passing through its center. The rolling axes are always parallel to the plane S. In FIGS. 1 and 2, the castors 20 to 23 are shown in a particular position, hereinafter termed the "aligned position". In the aligned position the rolling axes of the castors 20 to 23 are all perpendicular to the axis 16. Moreover, in this aligned position, the braking torque that is exerted on each of these castors is minimum and preferably zero. In this embodiment, in the aligned position the castors 20 to 23 are aligned one behind the other along the axis 16. The castors 20 and 23 are the castors that are respectively nearest the front and nearest the back in the direction X.

Each castor 20 to 23 is also movable in rotation about a respective rotation axis parallel to the direction Z. In FIG. 2, these rotation axes of the castors 20 to 23 carry the reference numbers 26 to 29, respectively.

With the exception of their position relative to one another under the footplate 8, these castors 20 to 23 are structurally identical to one another. Accordingly, only the castor 20 is described in detail, with reference to FIG. 3.

Figure 3:
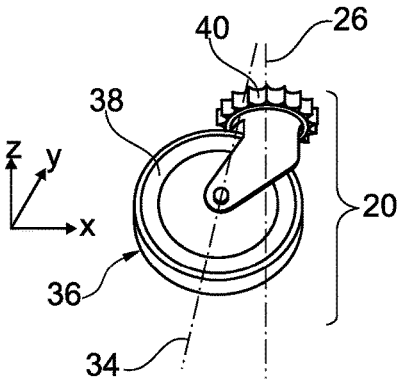
FIG. 3 is a diagrammatic perspective view of a castor of the device from FIG. 1.

In FIG. 3, the rolling axis of the castor 20 carries the reference 34. The castor 20 includes a tread 36 intended to come directly into contact with the ground 4 when the castor 20 rolls over the ground 4. The tread 36 is often made of polymer and preferably a polymer material having a high coefficient of friction. Here the tread 36 also has on either side of the castor 20 vertical flanks 38 that do not come directly into contact with the ground 4.

The axis 34 is offset toward the front of the rotation axis 26. In other words, the shortest distance Δ between the axis 34 and the axis 26 is non-zero. This distance Δ is typically greater than 1 cm, 2 cm or 3 cm. Moreover, as can be seen in FIG. 2, during use of the skate 6 this axis 34 is in front of the axis 26 in the direction of movement of the footplate 8.

The distance Δ is chosen so that the point of contact between the ground 4 and the castor 20 is as close as possible to the position of the contact point that would be obtained by maintaining the castor 20 locked in the aligned position.

The castor 20 also includes a sprocket 40 mounted to rotate about the axis 26. To be more precise, the revolution axis of this sprocket 40 coincides with the axis 26. The sprocket 40 is fixed with no degree of freedom relative to the axis 34 and therefore pivots at the same time as this axis 34 about the axis 26.

Figure 4:
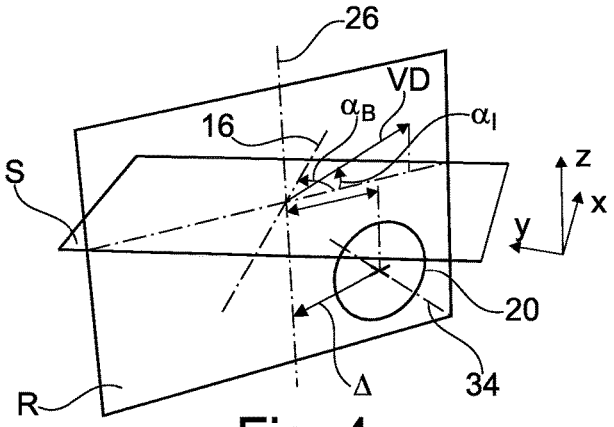
FIG. 4 is a diagram showing various planes and axes of the device from FIG. 1, used to define a turn angle $\alpha_B$ and a tilt angle $\alpha_I$.

FIG. 4 is used to define what is designated by the "turn angle $\alpha_B$" and the "tilt angle $\alpha_I$" of the footplate 8. To simplify this FIG. 4, only the castor 20 is diagrammatically represented by a circle. In this figure, the plane S and the axes 16, 26 and 34 correspond to the plane and axes defined above. Also shown by a vector is the instantaneous direction VD of movement of the footplate 8. The angle $\alpha_B$ is the angle between the axis 16 and the orthogonal projection of the direction VD in the plane S. The angle $\alpha_I$ is the angle between the plane S and the direction VD.

The rolling plane R of the castor 20 is the plane passing through the center of the castor 20 and perpendicular to its rolling axis 34. As will emerge hereinafter, the rotation of the castor 20 about its axis 26 is controlled to maintain the plane R at all times parallel to the direction VD in order to prevent the castor 20 skidding along the ground 4 when braking.

FIG. 4 also shows the distance Δ between the axes 26 and 34 of the castor 20.

Figure 5:
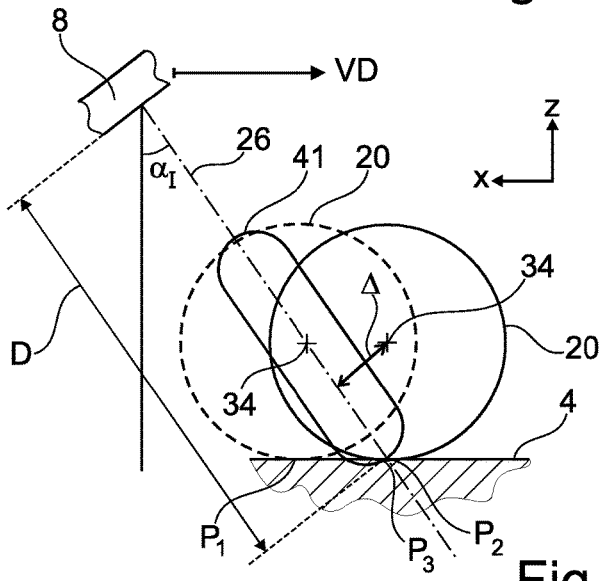
FIG. 5 is a diagram showing the castor from FIG. 3, used to explain the benefit of offsetting the rolling axis of this castor relative to its rotation axis.

FIG. 5 shows diagrammatically the castor 20 and part of the footplate 8 in a situation in which the direction VD is horizontal and the angle αB is equal to 90°. In this figure the rolling plane of the castor 20 is parallel to the direction VD. The position of the castor 20 when the distance Δ is non-zero is represented in solid line. The position of the castor 20 when the distance Δ is zero is represented in dashed line. The position of a castor 41 is also represented in solid line by an oblong shape. The castor 41 is identical to the castor 20 except that it is locked against rotation about the axis 26 in the aligned position. Consequently, the position of the castor 41 corresponds to that which is observed with a known skate when the user pivots the footplate of the skate to skid in the direction VD perpendicular to the longitudinal axis of the footplate in order to brake quickly.

The points P1 and P2 correspond to the positions of the points of contact between the castor 20 and the ground in the position represented in dashed line and in the position represented in solid line, respectively. The point P3 corresponds to the position of the point of contact between the castor 41 and the ground 4. To simplify, to a first approximation, the position of the point P3 coincides with the intersection of the axis 26 and the ground 4.

In FIG. 5 it is seen that a zero distance Δ corresponds to a point $P_1$ distant from the point $P_3$ in the direction VD. Conversely, when the distance Δ is non-zero, the point $P_2$ is displaced toward the point $P_3$ in the direction VD. There even exists a value Δp of the distance Δ for which the distance between the points $P_2$ and $P_3$ in the direction VD is zero as shown in FIG. 5. Minimizing this distance between the points $P_2$ and $P_3$ in the direction VD is of interest because this makes the use of the skate 6 more intuitive and similar to that of known skates. The value Δp that cancels out the distance between the points $P_2$ and $P_3$ in the direction VD is given by the following equation: $\Delta p = D^*\sin(\alpha_I)/\sin(\alpha_B)$, in which D is the distance between the lower face 14 of the footplate 8 and the ground 4 along the axis 26. This value Δp varies as a function of the values of the angles $\alpha_I$ and $\alpha_B$. However, in this embodiment the distance Δ is constant. Accordingly, to minimize this distance between the points $P_2$ and $P_3$ in most situations of use, here the distance Δ is taken as equal to $D^*\sin(\alpha_{IC})/\sin(\alpha_{BC})$ plus or minus 20% or plus or minus 10% or plus or minus 5%, where $\alpha_{IC}$ and $\alpha_{BC}$ are taken as equal to 20° and 30°, respectively. The values $\alpha_{IC}$ and $\alpha_{BC}$ correspond to average values observed on known skates when braking by skidding.

For example, here the distance D is equal to 90 mm, which results in a distance Δ equal to 61.5 mm.

Figure 6:
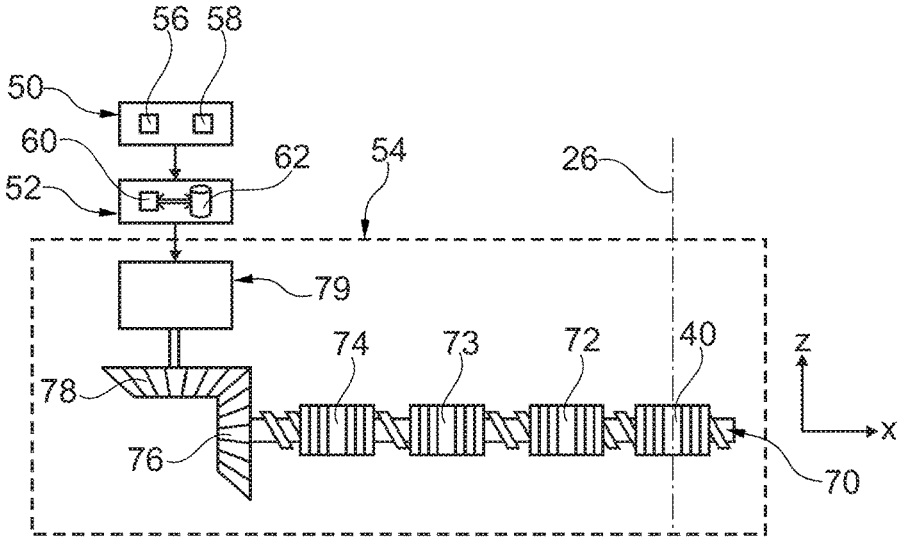
FIG. 6 is a diagram showing a turn device of the castors of the device from FIG. 1.

FIG. 6 shows the various elements of the skate 6 employed to maintain the rolling plane of each of the castors 20 to 23 parallel to the direction VD when braking. To this end, the skate 6 includes:

- an inertial center 50 capable of measuring physical parameters representing the angles $\alpha_B$ and $\alpha_I$, i.e. physical parameters from which the values of these angles $\alpha_B$ and $\alpha_I$ can be determined,
- a central unit 52 that establishes on the basis of measurements from the inertial center 50 a command to pivot the castors 20 to 23 about their respective rotation axes, and
- an electromechanical turn device 54 able to cause the castors 20 to 23 to pivot simultaneously about their respective rotation axes by an angle imposed by the pivoting command established by the central unit 52.

The inertial center 50 is fixed relative to the footplate 8 with no degree of freedom. The inertial center 50 typically includes a three-axis rate gyro and a three-axis accelerometer 58. The rate gyro 56 measures the angular rotation speed of the footplate 8 about three non-collinear axes that are advantageously mutually orthogonal. For example, the measuring axes of the rate gyro 56 are parallel to the directions X, Y and Z. Similarly, the measuring axes of the accelerometer 58 are preferably parallel to the directions X, Y and Z. The accelerometer 58 enables measurement of the direction VD and integrating measurements from the rate gyro 56 enables calculation of the angles $\alpha_B$ and $\alpha_I$.

The central unit 52 typically includes a programmable electronic computer 60 adapted to execute instructions stored on an information storage medium. To this end, the central unit 52 also includes a memory 62 that contains the instructions necessary for executing the method from FIG. 9.

Figure 7:
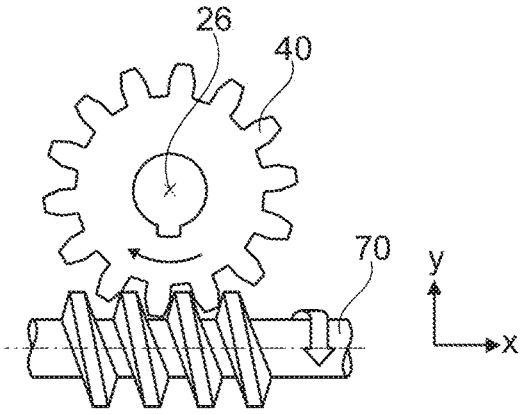
FIG. 7 is a diagrammatic plan view of a part of the turn device from FIG. 6.

The device 54 is a controllable electric device adapted to cause the castors 20 to 23 to pivot simultaneously in response to pivoting commands transmitted by the central unit 52. To this end, this device 54 includes a lead screw 70 that extends parallel to the axis 16 of the footplate 8. This screw 70 is situated under the footplate 8 and meshes directly and simultaneously with each of the sprockets of the castors 20 to 23. In FIG. 6, the sprockets of the castors 21 to 23 carry the reference numbers 72, 73 and 74, respectively. The meshing of the sprocket 40 with the screw 70 is shown in more detail in FIG. 7. The screw 70 turns on itself about its longitudinal axis, which extends parallel to the axis 16.

A conical or frustoconical gear 76 is fixed with no degree of freedom relative to a proximal end of the screw 70. The revolution axis of this gear 76 coincides with the longitudinal axis of the screw 70.

The gear 76 meshes directly with another conical or frustoconical gear 78, the perpendicular revolution axis of which is parallel to the direction Z.

The device 54 also includes a controllable electrical actuator 79 that drives the gear 78 in rotation about its revolution axis. The actuator 79 is controlled by the central unit 52. For example, the actuator 79 is an electric stepper motor or the like.

Figure 8:
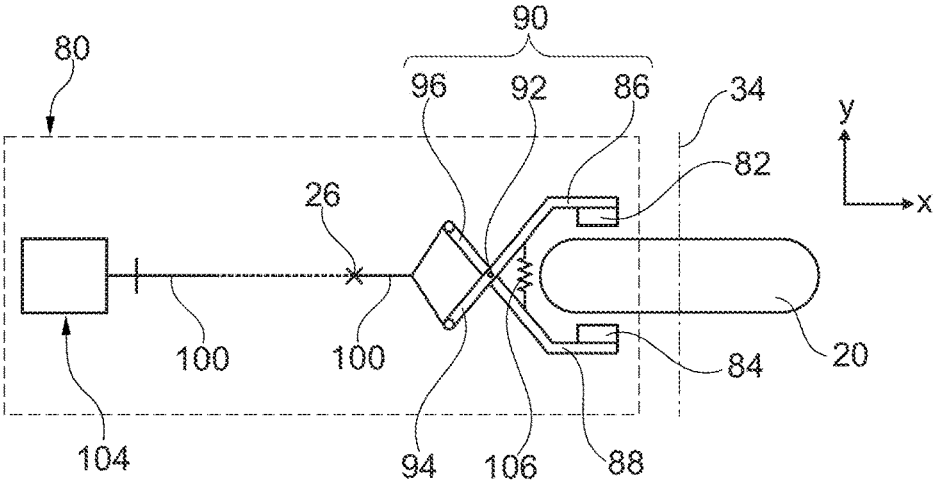
FIG. 8 is a diagram showing a braking device of the device from FIG. 1.

The skate 6 also includes an electromechanical device 80 shown in FIG. 8 for braking each of the castors 20 to 23. To simplify the description and FIG. 8, only the braking of the castor 20 is shown and described in detail. The braking of the other castors 21 to 23 is obtained in the same manner as that described for the castor 20. Moreover, the actuator that pulls on the brake cable is typically common to all of the castors to be braked.

Here the device 80 includes two brake pads 82 and 84. Each of these pads 82 and 84 is movable between an advanced position and a retracted position. Only the retracted position is shown in FIG. 8. In the advanced position the pads 82 and 84 exert pressure on the castor 20 to brake it. For example, the pads 82 and 84 rub on the flanks 38 of the castor 20 to brake it. In the retracted position the pads 82 and 84 exert no or minimal pressure on the castor 20 so that the latter is not braked. Here, in the retracted position, the pads 82 and 84 do not rub on the castor 20. The pads 82 and 84 are typically made from polymer to increase the coefficient of friction. Here each pad 82, 84 is positioned facing a respective flank 38 of the castor 20.

By way of illustration, each of the pads 82 and 84 is placed at a respective end of jaws 86 and 88 of pincers 90. These jaws 86, 88 are mounted to rotate about the same axis 92 parallel to the direction Z. On the other side of the axis 92 each jaw 86, 88 is extended by a respective handle 94 and 96. The corresponding handle and jaw form a single rigid part. Each distal end of the handles 94 and 96 is mechanically attached to a respective end of a brake cable 100. In FIG. 8, the dashed lines in the representation of the cable 100 indicate only that the cable 100 is not shown in its entirety. The cable 100 extends from the distal ends of the handles 94, 96 as far as the axis 26, then rises along the axis 26 in the direction Z as far as the footplate 8 and then extends under the footplate 8 as far as an actuator 104. The actuator 104 is able to pull on the proximal end of the cable 100 until the pressure exerted by the pads 82, 84 on the flanks 38 is equal to a pressure set point. The pressure set point is typically contained in the braking command sent to the actuator 104 by the central unit 52. To be more precise, when the actuator 104 pulls on the cable 100, the distal ends of the handles 94, 96 move toward one another, which moves the pads 82, 84 from their retracted position toward their advanced position. The actuator 104 is an electrical actuator controlled by the central unit 52.

The device 80 also includes a return member 106 that automatically returns the pads 82 and 84 from their advanced position to their retracted position when the cable 100 is relaxed. The block 106 typically urges the pads 82 and 84 at all times toward their retracted position. For example, the block 106 is a spring or a block of rubber accommodated between the jaws 86 and 88 to exert a return force on these jaws at all times that moves them away from one another.

The pads 82, 84, the pincers 90 and the member 106 are fastened to the castor 20 and pivot at the same time as the castor 20 pivots about its axis 26. For its part the actuator 104 is fixed relative to the footplate 8 with no degree of freedom.

The actuators 80 and 104, the central unit 52 and the inertial center 50 are housed inside the same casing 110 (FIG. 1) fixed to the footplate 8 with no degree of freedom. Here this casing 110 is fixed to the rear of the shoe 12. Moreover, the casing 110 includes an electrical power supply 112 (FIG. 1) that supplies electricity to all of the elements of the skate 6 that require this kind of power supply. For example, the source 112 is a rechargeable or non-rechargeable electrical cell or battery.

Figure 9:
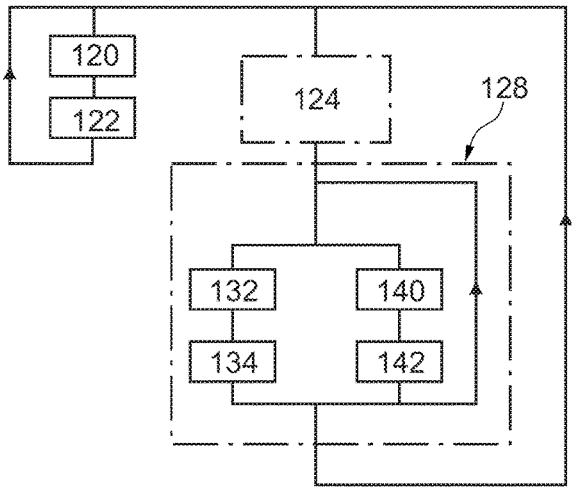
FIG. 9 is a flowchart of a method of operating the device from FIG. 1.

The operation of the device 2 will now be described with reference to the FIG. 9 method.

The user initially puts on each of the skates and then begins to skate and thus to roll over the ground 4.

Starting from this moment, during a step 120, the inertial center 50 measures continuously the angular speed and the acceleration of the footplate 8 in the directions X, Y and Z and then transmits each of these measurements to the central unit 52.

During a step 122, the central unit 52 acquires these measurements in order to process them. In particular, the central unit 52 calculates the values of the angles $\alpha_I$ and $\alpha_B$. The steps 120 and 122 are reiterated continuously for as long as the device 2 is being used.

In parallel, the user starts with a phase 124 of acceleration or of movement at constant speed during which they do not wish to brake. For example, the user moves by performing what is known as the "skater's step". During the execution of the skater's step, whenever a skate is rolling over the ground 4 the axis 16 and the direction VD are aligned. Thus, during this phase 124, the central unit 52 maintains the castors in their aligned position at least when they are rolling over the ground 4. Consequently, during this phase 124, no braking torque is exerted on the castors 20 to 23 by the device 80. The pads 82 and 84 are therefore held in their retracted position.

When the user wishes to brake, they turn their skates sharply so that the angle $\alpha_B$ and possibly the angle $\alpha_I$ vary suddenly. A sudden variation of one of these angles $\alpha_B$ or $\alpha_I$ is here interpreted by the central unit 52 as signaling that the user wishes to brake. The phase 124 is immediately interrupted and there follows a braking phase 128.

During the phase 128, and to be more precise during a step 132, the central unit 52 establishes a command to pivot the castors 20 to 23 to maintain their respective rolling planes parallel to the direction VD and to place their respective rolling axes in front of their respective rotation axes in the direction VD. For example, the central unit 52 to this end establishes a pivoting command that causes each of the castors 20 to 23 to pivot about its rotation axis by an angle $-\alpha_B$ opposite the calculated angle $\alpha_B$. This pivoting set point is incorporated into the pivoting command that is transmitted to the turn device 54 and to be more precise to its actuator 79.

In response, during a step 134 the actuator 79 turns the gear 78 through an angle corresponding to the set point contained in the received pivoting command. The rotation of the gear 78 leads to corresponding rotation of the screw 70 via the gear 76. The rotation on itself of the screw 70 simultaneously drives in rotation all the sprockets 40 and 72 to 74. This therefore causes simultaneous pivoting of the castors 20 to 23 about their respective rotation axes to maintain the rolling plane of each of these castors parallel to the direction VD. Under these conditions, the footplate 8 and to be more precise the axis 16 of this footplate is no longer parallel to the direction in which the castors 20 to 23 are rolling.

Moreover, during a step 140 in parallel with the steps 132 to 134 the central unit 52 establishes a command to brake the castors 20 to 23 in order to exert a braking torque on each of the castors 20 to 23, the amplitude of which increases as the absolute values of the angles $\alpha_B$ and $\alpha_I$ calculated during the step 130 increase. For example, the central unit 52 calculates a pressure set point that increases with the absolute values of the angles $\alpha_B$ and $\alpha_I$. Here the central unit 52 utilizes the following equation, in which $\gamma$ is a predetermined positive constant, to establish the pressure set point Cp:

$$Cp=|\alpha_B|*|\alpha_I|*\gamma$$

The set point Cp determined in this way is then incorporated into a braking command established by the unit 52 and then transmitted to the braking device 80 and to be more precise to its actuator 104.

In response, during a step 142 the actuator 104 pulls on the cable 100 until the pressure exerted by the pads 82 and 84 on the flanks 38 of the castors is equal to the pressure set point Cp contained in the received braking command.

When the user no longer wishes to brake, they move the skate 6 to realign its longitudinal axis with the direction VD and keep the footplate 8 parallel to the ground 4. Under these conditions, the angles $\alpha_B$ and $\alpha_I$ are canceled out. Execution of the step 134 immediately returns the castors 20 to 23 to their aligned position. Similarly, execution of the step 140 leads to a zero pressure set point. Then, on the next execution of the step 142, the actuator 104 relaxes the cable 100 until the pads 82 and 84 no longer exert any pressure on the castor 20. The block 106 then automatically returns the pads 82 and 84 to their retracted position.

The braking phase then ends and the user returns to the movement phase 124.

It will be noted that the device 2 enables the user to "snow plow" brake, i.e. to brake by placing the skates in the same position that they would use to snow plow brake on skis or ice skates.

Figure 10:
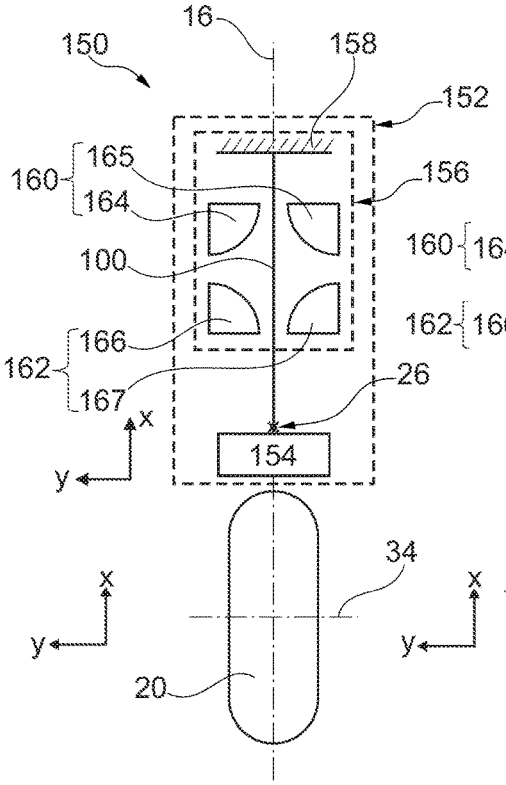
FIGS. 10 and 11 are diagrammatic plan views of another embodiment of a braking device of the castors of the device from FIG. 1.

FIG. 10 shows a skate 150 identical to the skate 6 except that the braking device 80 is replaced by an electromechanical braking device 152. To simplify FIG. 10, only the elements of the skate 150 that differ from those of the skate 6 are shown and described in more detail. The other elements are identical to those of the skate 6. In particular, the device for turning the castors 20 to 23 of the skate 150 is the same as that of the skate 6. Only the braking device of the castor 20 is shown in FIG. 10. The braking devices of the other castors 21 to 23 are identical to the braking device of the castor 20.

The device 152 includes pads movable from a retracted position to an advanced position when the brake cable 100 is pulled. These pads return automatically to their retracted position when the cable 100 is relaxed. For example, the device 152 to this end includes the pincers 90 and the pads 82, 84. In FIG. 10, the pincers 90 and the pads 82, 84 are diagrammatically represented by a rectangle 154.

In contrast to the device 80, the cable 100 is alternately tensioned and relaxed not by a dedicated actuator such as the actuator 104 but by means of the same electrical actuator 79 used in the turning device 54. To this end, the device 152 includes a mechanism 156 that transforms pivoting of the castor 20 about the axis 26 into a tension in the cable 100. Here the mechanism 156 tensions the cable 100 more as the absolute value of the pivoting angle of the castor 20 about the axis 26 increases. Thus the mechanism 156 transforms pivoting of the castor 20 into movement of the pads 82, 84 toward their advanced position. Conversely, as the pivoting angle decreases, the tension in the cable 100 decreases. When the castors are in their aligned position the pads 82 and 84 are in their retracted position. To this end, by way of illustration, the mechanism 156 includes an anchor point 158 to which the proximal end of the cable 100 is attached with no degree of freedom. The point 158 is fixed relative to the footplate 8 with no degree of freedom. The opposite ends of the cable 100 are attached with no degree of freedom to the ends of the handles 94 and 98 as described with reference to FIG. 8. The mechanism 156 also includes two pairs of facing pawls 160, 162. The pair 160 is fixed under the footplate 8 with no degree of freedom. The pair 162 is fastened to the castor 20 and pivots at the same time as the castor 20 about the axis 26. The pair 162 is preferably placed in front of the rotation axis 26, i.e. on the opposite side of the axis 26 to the side on which the pincers 90 and the rolling axis 34 are located. The shortest distance between the pair 162 and the axis 26 is typically greater than 5 mm or 1 cm and generally less than 10 cm.

Figure 12:
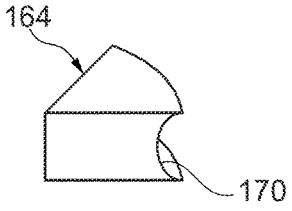
FIG. 12 is a diagrammatic perspective view of a pawl used in the braking device from FIG. 10.

Each pair 160, 162 includes two pawls 164, 165 and 166, 167 respectively. The cable 100 passes between the two pawls 164 and 165 and then between the two pawls 166 and 167. The pawls 164 and 165 are symmetrical to one another relative to a plane parallel to the directions X and Z and passing through the axis 26. The two pawls 166 and 167 are symmetrical to one another relative to a plane perpendicular to the axis 34 and passing through the axis 26. In the aligned position the pairs 160 and 162 are symmetrical relative to a plane perpendicular to the axis 16. Accordingly, only the pawl 164 is described in more detail now with reference to FIG. 12.

Here the pawl 164 corresponds to one quarter of a wheel having a circular groove 170 on its exterior periphery. The dimensions of this groove 170 are sufficient to receive the cable 100 and to prevent it from sliding in the direction Z when the cable is bearing on and received in this groove.

Figure 11:
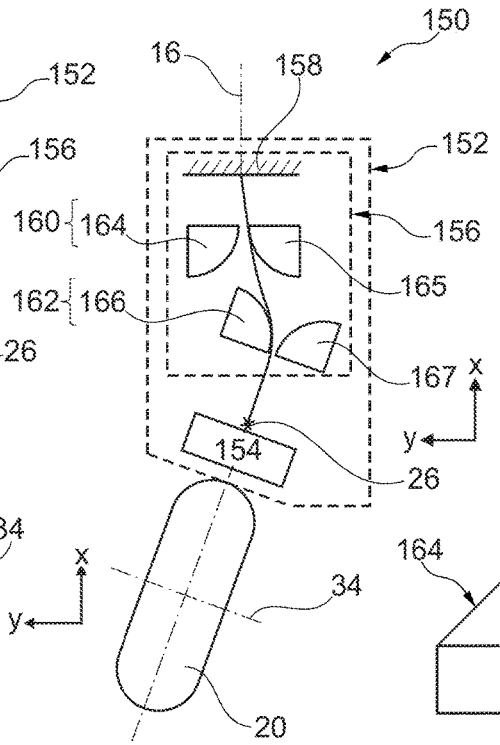

As shown in FIG. 11, when the wheel 20 pivots about the axis 26 the pawls 165 and 166 come to bear on the cable 100 and bend it. Given that the proximal end of the cable 100 is attached with no degree of freedom to the anchor point 158, this bending of the cable 100 results in traction on the distal ends of the handles 94 and 96. This traction leads to closing of the jaws 86 and 88 and therefore to braking of the castor 20 by friction with the pads 82 and 84. With a device 152 the amplitude of the braking torque increases as the amplitude of the pivoting of the castor 20 about the axis 26 increases, i.e. as the absolute value of the angle $\alpha_B$ increases. On the other hand, in this embodiment, the amplitude of the braking torque is independent of the value of the angle $\alpha_I$.

Numerous other embodiments are possible. For example, even in the case of the skate 6 control of the braking torque as a function of the angle $\alpha_I$ can be omitted. In this case the skate 6 can be simplified. In particular the measurement of the angle $\alpha_I$ can be omitted.

The braking torque exerted on the castors is not necessarily proportional to the absolute value of the angle $\alpha_B$. For example, in another embodiment, the amplitude of the braking torque is constant and non-zero as soon as the angle $\alpha_B$ is greater than a predetermined threshold. The amplitude of the braking torque can also increase in a nonlinear manner, for example exponentially, as a function of the absolute value of the angle $\alpha_B$.

The braking of a castor can be effected differently. For example, braking can also be effected using electromagnetic force. In this latter case, one or more permanent magnets are typically fixed with no degree of freedom to the castor and the braking device includes coils adapted to generate magnetic fields that brake the movement of the permanent magnets.

In another variant the braking device includes only one pad or to the contrary more than two pads adapted to rub on the same castor. The braking device can also be produced, for example, as described in the application US2013277924 except that the brake cable is pulled by the actuator 104 and not by a rearward movement by the user.

The mechanism 156 can be produced differently. For example, the number of pawls can be different. Moreover, other embodiments of the pawl 164 are possible. For example, if the height of the pawl is sufficient, the groove 170 is omitted. The face of the pawl intended to bear on the cable 100 preferably has no asperities liable to damage or to wear this cable 100. However, to this end, this bearing face has no need to be circular, and can be elliptical.

The braking device can also be adapted to brake only a limited number of castors and not all the castors of the device 2. For example, only the castors 20 and 23 are braked. The other castors 21 and 22 are not braked.

Other embodiments of the turning device are possible. For example, the sprocket 40 can be replaced by a single toothed angular sector. In another embodiment, the turning device includes an actuator for each castor that drives the castor directly in rotation about its rotation axis. In this case the lead screw 70 and the sprockets 40 and 72 to 74 are omitted.

Numerous other embodiments of the castors are possible. For example, a damper can be accommodated between each castor and the footplate to damp bumps and asperities of the ground. A damper of this kind typically introduces an additional degree of freedom of movement of the castor relative to the footplate in the direction Z.

Nor is it any longer necessary for the castors to be always entirely situated under the footplate as in the examples described above. In fact, it suffices for at least part of the tread of the castor to be under the footplate. The other part of the tread can project above the footplate via a housing provided for this purpose in the footplate.

There can be any number of castors. For example, one variant of the locomotion device includes only one castor or two or more castors.

In addition to the castors the turn angle of which is controlled by the turning device, the locomotion device can also include additional free castors. These free castors are mounted to rotate freely about their respective rotation axes. The rolling axis of these free castors is preferably also offset a non-zero distance Δ from their rotation axis so that they are aligned automatically without the assistance of the electrical actuator with the instantaneous direction of movement of the device. One of these free castors can be used to measure the angle $\alpha_B$, for example.

In one particular embodiment the locomotion device includes only free castors. In this case the turning device is omitted.

Alternatively, the locomotion device includes a mechanism for adjusting the distance Δ. For example, this mechanism is a sliding rail mechanism or a track mechanism that enables adjustment of the distance Δ even when the locomotion device is being used. In this case the locomotion device preferably also includes a controllable electrical actuator that moves the adjustment mechanism as a function of a command to adjust the distance Δ generated by the central unit 52. At the time of each command the central unit typically generates an adjustment command that during braking maintains the distance Δ equal to the distance $D*\sin(\alpha_I)/\sin(\alpha_B)$.

In another variant the distance Δ is constant and zero.

The central unit 52 can include one or more electronic computers. When it includes a plurality of electronic computers, one of them is for example specifically programmed to control the turning device while another of these electronic computers is specifically programmed to control the braking device.

In the case of the skates described above and in the more general case in which the device includes first and second footplates mechanically independent of each other each receiving a respective foot of the user, the first central unit fixed to the first footplate and the second central unit fixed to the second footplate respectively include first and second transceivers. These transceivers enable exchange of data between the first and second central units. For example, the first central unit transmits to the second central unit data on the braking torque and/or the turn angle that it is commanding. In response, the second central unit takes account of the received data to determine the braking torque and/or the turn angle to be applied to the castors fixed to the second footplate. For example, thanks to the data transmitted, the difference between the braking torques applied to the castors fixed to each of these footplates is limited. These transceivers are typically wireless transceivers such as Bluetooth or Wifi radio transceivers.

The central unit 52 can be programmed differently. For example, as an alternative, during the phase 124, the unit 52 commands the devices 54 and 80 to maintain the castors 20 to 23 in the aligned position. When the unit 52 detects that the user wishes to brake, it responds by proceeding immediately to the phase 128 in which it maintains the rolling plane of each castor aligned with the direction VD and at the same time brakes each castor as described above. For example, the unit 52 detects that the user wishes to brake if the angle $\alpha_B$ varies suddenly. A sudden variation of the angle $\alpha_B$ can be detected by continuously comparing the derivative with respect to time of the angle $\alpha_B$ to a predetermined threshold SB. As long as this threshold SB is not crossed, the unit 52 remains in the phase 124 in which the castors are maintained in the aligned position. When this threshold SB is crossed, the unit 52 proceeds to the phase 128.

The inertial center 50 can include additional sensors such as, for example, a three-axis magnetometer. These additional sensors measure additional information that is transmitted to the central unit 52. The central unit 52 can use this additional information on the movement of the footplate 8 to improve the determination of the angle $\alpha_B$ or $\alpha_I$. This central unit can also use this additional information to establish pivoting or braking commands that are additionally a function of its orientation in the terrestrial magnetic field.

Alternatively, the rate gyro 56 is replaced by a gyroscope that measures directly rotation about the axes X, Y and Z rather than the angular speed in those directions.

The power supply 112 can include an energy recovery system enabling generation of electricity for supplying power to the braking and turning devices. For example, the energy recovery system includes photovoltaic panels or a dynamo, the rotor of which is driven in rotation by the rotation of the castors about their respective rolling axis. The energy recovery system can be used to power the braking and turning devices directly or simply for charging the battery.

The energy recovery system can also employ other energy sources present in the environment in which the locomotion device is used, for example vibrations of the wheels caused by irregularities of the ground over which the device is moving.

The housing 110 can be placed elsewhere than behind the shoe 12. For example, the housing can be accommodated on or under the footplate 8. In this case, the mechanism transmitting movement of the actuators is adapted to function in this new position of the housing. In particular, the use of frustoconical gears may become of no utility depending on the position of the housing.

The locomotion device has been described hereinabove in the particular case where it is a roller skate. However, everything described above applies to any type of locomotion device with castors used by a user to move over the ground. In particular, what has been described hereinabove applies to skateboards, scooters, skis on castors or roller skis. In the case of a skateboard or a scooter, the locomotion device does not include any device for attaching the feet of the user to the footplate.

The invention claimed is:

1. A locomotion device with castors for moving over the ground, the device comprising:

a footplate extending primarily in a footplate plane and on which at least one foot of a user is intended to be placed when the device is being used by the user;

at least one castor mechanically connected to the footplate to roll over the ground, the castor being mounted to rotate about a rolling axis parallel to the plane of the footplate and also about a rotation axis perpendicular to the plane of the footplate;

an inertial center configured to measure a physical parameter representing a turn angle, the turn angle being an angle between a longitudinal axis of the footplate and an orthogonal projection on the footplate plane of an instantaneous direction of movement of the footplate, the longitudinal axis being fixed with no degree of freedom relative to the footplate and contained in the plane of the footplate;

a central unit programmed to establish a braking command based on the measured physical parameter and to transmit the established braking command to a controllable electromechanical braking device; and the controllable electromechanical braking device configured to exert a braking torque on the castor based on the received braking command.

2. The device as claimed in claim 1, further comprising:

a controllable electromechanical turning device configured to turn the castor and cause the castor to pivot about its rotation axis by an angle determined based on a received pivoting command, wherein the central unit is further programmed to establish, at a time of each command to pivot the castor and based on the measured physical parameter at that time, the pivoting command that maintains the rolling axis of the castor perpendicular to the instantaneous direction of movement of the footplate.

3. The device as claimed in claim 2, wherein the controllable electromechanical braking device and the controllable electromechanical turning device include a common controllable electrical actuator configured to cause the castor to pivot through a predetermined angle about its rotation axis in response to the pivoting command.

4. The device as claimed in claim 2, wherein a shortest distance between the rolling axis of the castor and the rotation axis of the same castor is greater than or equal to 1 cm and the central unit is programmed to establish at a time of each command a pivoting command that additionally maintains the rolling axis of the castor in front of its rotation axis in the instantaneous direction of movement of the footplate.

5. The device as claimed in claim 2, wherein the controllable electromechanical turning device includes:

a sprocket fixed with no degree of freedom to the castor and mounted to rotate about the rotation axis of that castor;

a lead screw meshing with the sprocket and extending parallel to the plane of the footplate; and an electrical actuator configured to cause the lead screw to turn through a particular number of turns determined from the pivoting command received to cause the castor to pivot through a corresponding angle about its rotation axis.

6. The device as claimed in claim 1, wherein the controllable electromechanical braking device includes:

at least one pad movable between an advanced position to exert pressure on the castor to brake the castor and a retracted position to exert no pressure or a lower pressure on the castor; and a mechanism configured to transform pivoting of the castor in one direction about its rotation axis into a movement of the pad from its retracted position to its advanced position and pivoting of the castor in the opposite direction about its rotation axis into movement of the pad from its advanced position to its retracted position.

7. The device as claimed in claim 6, wherein the controllable electromechanical braking device includes a return member configured to continuously exert a force that returns the pad to its retracted position, and the mechanism configured to transform pivoting of the castor into movement of the pad includes:

a cable attached at one end with no degree of freedom to a fixed anchor point on the footplate and at the other end to the pad, and at least one pawl movable by the rotation of the castor between:

an eccentric position in which it tensions the cable and thus causes the movement of the pad from its retracted position to its advanced position against the return force of the return member, and an aligned position in which the cable is relaxed and therefore allows the pad to be moved from its advanced position to its retracted position by the return force of the return member.

8. The device as claimed in claim 1, wherein the controllable electromechanical braking device includes:

at least one pad movable between an advanced position to exert pressure on the castor to brake the castor and a retracted position to not exert any pressure or a lower pressure on the castor; and a controllable electrical actuator mechanically connected to the pad, and configured to exert on the pad pressure in the direction of the advanced position equal to a braking set point contained in the received braking command.

9. The device as claimed in claim 1, wherein the central unit is programmed so that the braking torque exerted by the controllable electromechanical braking device on the castor increases as the absolute value of the turn angle increases.

10. The device as claimed in claim 1, wherein the inertial center is further adapted to measure a physical parameter representing an angle of inclination of the footplate, the angle of inclination being the angle between the plane of the footplate and the instantaneous direction of movement of that the footplate and the central unit is further programmed to establish the braking command based on the measured physical parameter representing the inclination angle, the braking command established based on the physical parameter representing the inclination angle corresponding to a braking torque that increases as the absolute value of the inclination angle increases.

11. The device as claimed in claim 1, wherein the locomotion device is directly transportable by the user.

12. The device as claimed in claim 1, further comprising:

two footplates mechanically independent of each other, a respective foot of the user being intended to be placed on respective of the two footplates when the device is being used by the user; and fixed to each footplate, at least one of the at least one castor, one of the controllable electromechanical braking device, one of the inertial center, one of the central unit, and a transceiver configured to enable communication between the central units fixed to each of the footplates.

* * * * *